US006045458A

United States Patent [19]

Raymond

[11] Patent Number: 6,045,458

[45] Date of Patent: Apr. 4, 2000

[54] GOLF CLUB HEAD

[76] Inventor: David Raymond, 26 Pamela Ct., Tolland, Conn. 06084

[21] Appl. No.: 09/114,777

[22] Filed: Jul. 13, 1998

[51] Int. Cl.[7] ..... A63B 53/04

[52] U.S. Cl. ..... 473/328; 473/324

[58] Field of Search ..... 473/324, 328, 473/340, 344, 314

[56] References Cited

U.S. PATENT DOCUMENTS

| | | | |
|---|---|---|---|
| 1,139,738 | 5/1915 | Tyler | 473/328 |
| 3,810,631 | 5/1974 | Braly | 473/328 |
| 3,862,759 | 1/1975 | Evans et al. | 473/328 |
| 5,643,106 | 7/1997 | Baird | 473/328 |

*Primary Examiner*—Kien T. Nguyen
*Attorney, Agent, or Firm*—Cummings & Lockwood

[57] ABSTRACT

A golf club has a lobe defining a first club head thickness spaced between leading and trailing edges of the club face and on an opposite side of the club head relative to the face. An entry region of the club head is located below the lobe and adjacent to the leading edge on an opposite side of the club head relative to the face, and is spaced inwardly from the lobe to define a second club-head thickness less than the first club-head thickness. The entry region permits the club head to penetrate downwardly into a ground surface. A curved transition surface extends between the lobe and the entry region, and cooperates with the lobe to guide the club head generally forwardly after downward penetration of the leading edge into the ground.

18 Claims, 2 Drawing Sheets

GOLF CLUB HEAD

FIELD OF THE INVENTION

The present invention relates generally to a golf club head, and more particularly, to a golf club head which provides for ground surface penetration of the leading edge and forward movement of the club head, prior to deflection of the club head off of the ground surface.

BACKGROUND OF THE INVENTION

A typical sand wedge has a lobe or downward projection located on an opposite side of the club head relative to the face, and extending downwardly from the lower portion or leading edge of the club head, or is otherwise designed for preventing the leading edge from penetrating downwardly into and possibly getting stuck in the ground. A lobe or other downward projection bounces or deflects off of the ground, and in turn, provides "bounce" or a sharp upward movement to the club head typically at about the moment the leading edge contacts the ground. Bounce is particularly useful when a high-angled trajectory is needed to lift a golf ball out of a steep-lipped sand trap. As an example, U.S. Pat. No. Des 55,278 issued to Kraeuter shows a golf club head having a wide portion or lobe located adjacent to the leading edge of the club face to deflect the club head upwardly off of the ground surface during contact of the leading edge with the ground surface. U.S. Pat. No. 1,835,718 issued to Morton shows a curved wing for collecting sand therewithin, which acts as a cushion for bouncing the club upwardly and for minimizing the penetration of the leading edge of the club head into the ground surface. U.S. Pat. No. Des. 339,397 issued to Iinuma; U.S. Pat. No. Des. 294,850 issued to Simmons; U.S. Pat. No. Des. 389,541 issued to Huan-Chiang, and U.S. Pat. No. 5,480,145 issued to Sherwood, are further examples of golf club head designs which prevent or minimize ground surface penetration and/or deflect the club head upwardly generally upon contact of the leading edge of the club face with the ground.

One drawback with prior art golf club heads having lobes in the above-described or other structures designed for preventing or minimizing penetration of the leading edge into the ground, is that if the club head contacts the ground slightly behind the desired contact position, the design will cause the club head to bounce upwardly as the leading edge contacts the ground, to thereby mishit or "top" the ball. A club head which tops a ball imparts a low-angled and short trajectory thereto which is particularly undesirable, for example, when attempting to lift a golf ball out of a sand trap In response to the foregoing, it is an object of the present invention to provide a golf club head that overcomes the above-described drawbacks and disadvantages of prior art golf club heads.

SUMMARY OF THE INVENTION

The present invention is directed to a golf club head having a hosel for attaching the club head to a club shaft, a club face defining a heel portion adjacent to the hosel, a toe portion located on an opposite side of the face relative to the heel portion, a leading edge extending between the toe portion and the heel portion, and a trailing edge extending between the toe portion and the heel portion on an opposite side of the face relative to the leading edge. A lobe defining a first club head thickness is spaced between the leading edge and the trailing edge on an opposite side of the club head relative to the face, and projects outwardly therefrom.

An entry region of the club head is located below the lobe and adjacent to the leading edge on an opposite side of the club head relative to the face, and is spaced inwardly from the lobe to thereby define a second club-head thickness less than the first club-head thickness. The entry region permits the club head to penetrate downwardly into a ground surface. A curved transition surface extends between the lobe and the entry region. Upon a downward stroke of the club head, the leading edge, entry region and the curved transition surface penetrate downwardly into and forwardly along the ground surface prior to the lobe contacting the ground surface.

One advantage of the present invention is that if the club head contacts the ground slightly behind the desired contact position relative to a golf ball, the entry region of the club head first penetrates the ground surface, and then the lobe and the transition surface engage the ground surface and guide the club head generally forwardly and under the ball into proper striking position prior to deflection of the club head upwardly by the lobe.

Other objects and advantages of the present invention will become apparent in view of the following detailed description and accompanying drawings.

DETAILED DESCRIPTION OF THE PREFERRED EMBODIMENT

Figure 2:
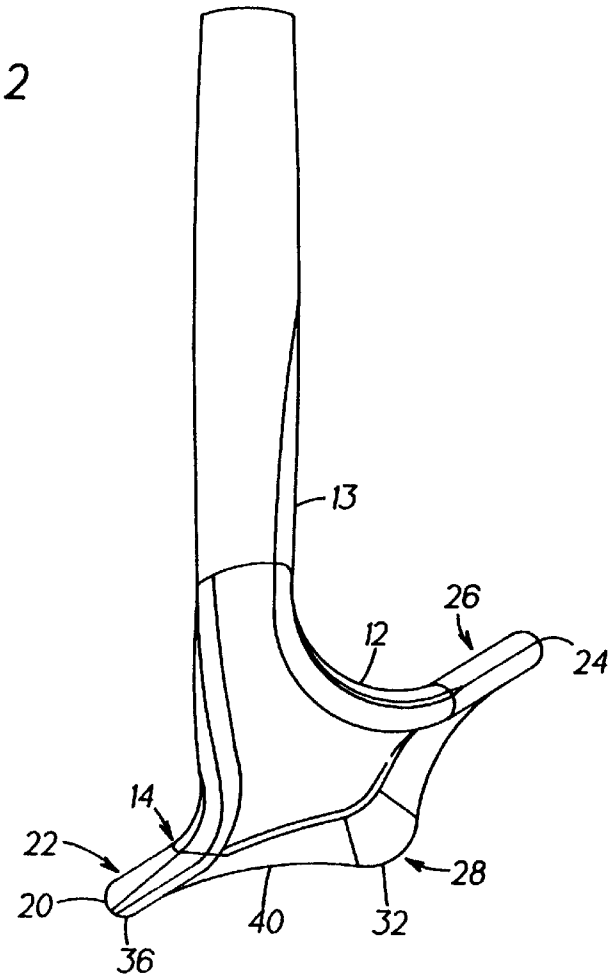
FIG. 2 is an opposite, side elevational view of the golf club head of FIG. 1.

Referring to FIGS. 1–4, a golf club head embodying the present invention is generally designated by the reference number 10. The club head 10 includes a hosel 12 for attaching the club head to a club shaft 13. The club head 10 further includes a club face 14 defining a heel portion 16 adjacent to the hosel 12, and a toe portion 18 located on an opposite side of the face 14 relative to the heel portion 16. The club face 14 further defines a leading edge 20 extending between the toe portion 18 and the heel portion 16 at a lower portion 22 of the face, and a trailing edge 24 extending between the toe portion 18 and the heel portion 16 at an upper portion 26 of the face.

Figure 1:
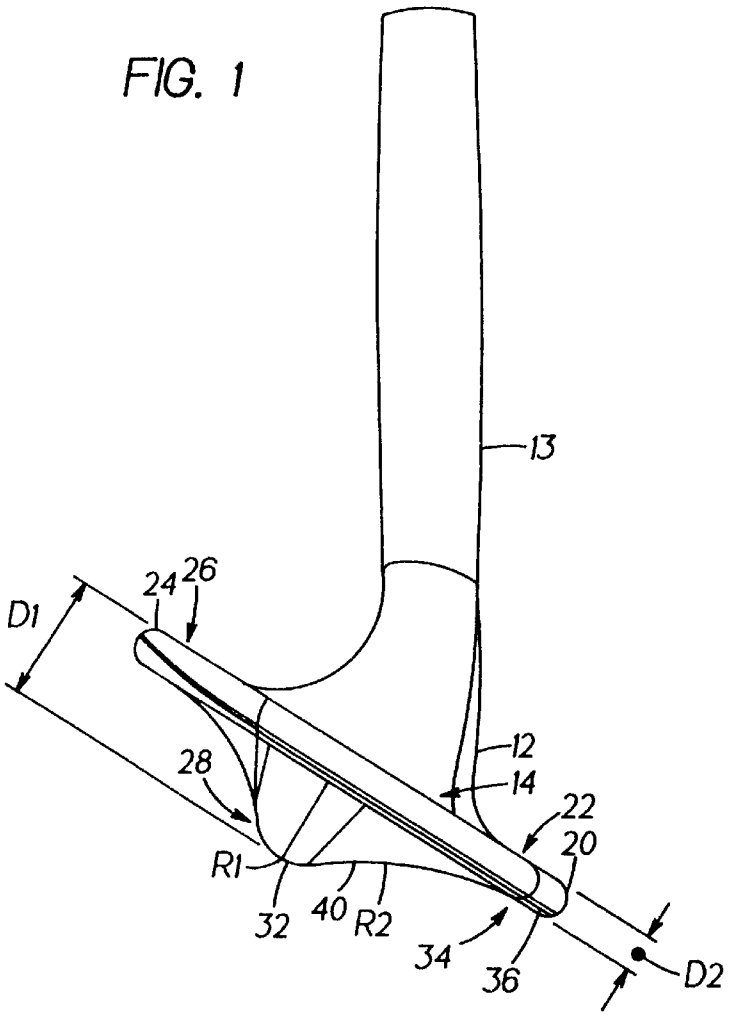
FIG. 1 is a side elevational view of a golf club head showing an entry region, curved transition surface and lobe in accordance with the present invention.
Figure 4:
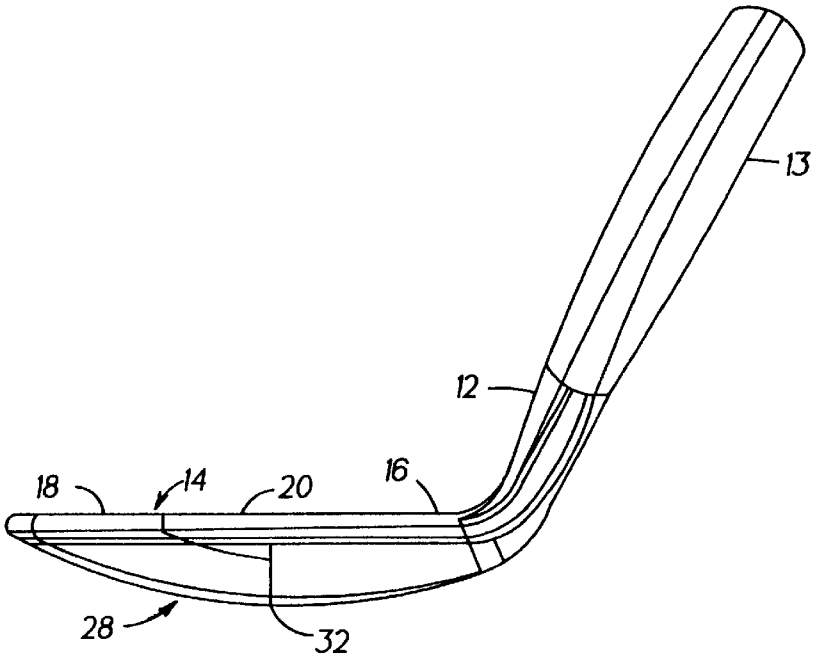
FIG. 4 is a bottom plan view of the golf club head of FIG. 1.
Figure 3:
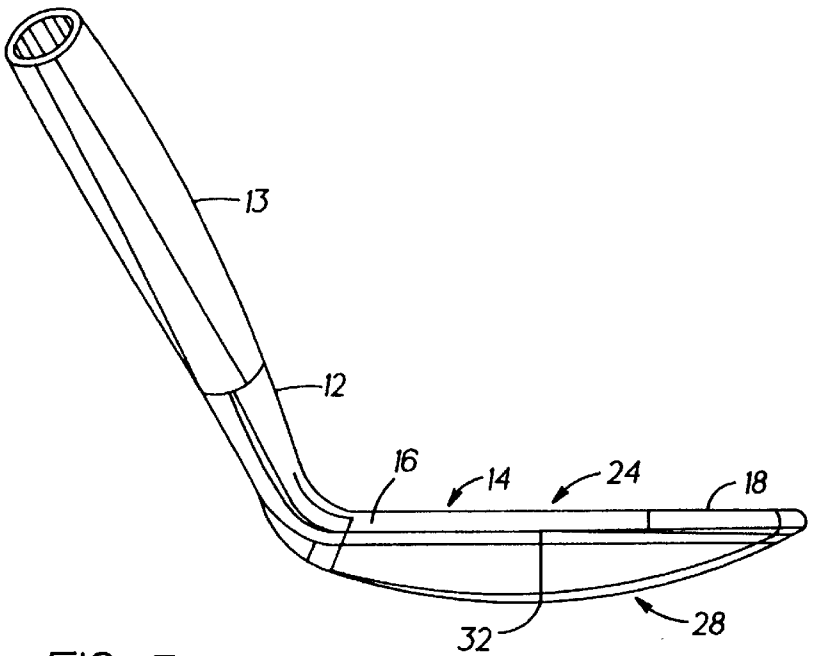
FIG. 3 is a top plan view of the golf club head of FIG. 1.

As best shown in FIGS. 1 and 2, the club head further includes a lobe 28 spaced between the leading edge 20 and the trailing edge 24 on an opposite side of the club head 10 relative to the face 14, and projecting outwardly therefrom. The lobe 28 defines a first club-head thickness "D1" between the face 14 of the club head and an outermost portion 32 of the lobe 28 relative to the face, and the exterior surface of the lobe 28 is preferably defined by a radius of curvature "R1". The club head 10 includes means for facilitating penetration of the leading edge 20 downwardly into a ground surface, including an entry region 34 located below the lobe 28 and adjacent to the leading edge 20 on an opposite side of the club head 10 relative to the face 14. The entry region 34 is spaced inwardly from the lobe 28 and defines a second club-head thickness D2 between the face 14 and a surface 36 of the entry region facing in a direction opposite to the face 14. As shown in FIGS. 1 and 2, the second club-head thickness D2 at the entry region 34 is less than that of the first club-head thickness D1 at the lobe 28. A curved transition surface 40 extends between the lobe 28 and the entry region 34, and is preferably a concave surface defining a relatively large radius of curvature "R2" in comparison to the first radius of curvature "R1" of the lobe 28. For example, a radius of curvature R1 of approximately 0.175 inches for the lobe 28 has been found to be suitable in conjunction with a radius of curvature R2 of approximately 3.375 inches for the curved transition surface 40. However, other suitable values of R1 and R2, and proportions between R1 and R2 may be employed. The curved transition surface 40 and the lobe 28 define means for guiding the club head generally forwardly upon penetration of the ground surface by the entry region 34. As shown in FIGS. 1 and 2, the club head thickness progressively increases in a direction from the entry region 34 (second club head thickness D2) to the lobe 28 (first club head thickness D1).

During a downward stroke or arc of the club head 10 embodying the present invention, the entry region 34 first contacts the ground surface. The relatively small club head thickness D2 of the entry region 34 provides a small surface area which permits the leading edge 20 and the entry region 34 to easily penetrate downwardly into the ground surface. As the club head 10 further penetrates downwardly into the ground surface, the club head thickness, and in turn, the surface area of the club head 10 penetrating the ground surfaces increases from the entry region 34 along the curved transition surface 40 to the lobe 28. This increasing surface area is resisted by the ground surface to resist further downward penetration of the club head 10 into the ground surface. The golf club head 10 is then guided generally forwardly by the curved transition surface 40 and the lobe 28 along the ground surface as the golf club head contacts the ground surface progressively along the curved transition surface and the lobe in a direction from the entry region 34 to the lobe 28. Upon the downward and forward movement of the golf club head 10, the lobe 28 contacts the ground surface and, in turn, deflects or "bounces" the club head upwardly off of the ground surface.

If the club head 10 strikes the ground at the desired contact position, the face 14 will remain under the ball in proper striking position during the downward and forward movement of the club head and when the lobe 28 deflects or bounces upwardly off of the ground surface. If the club head 10 strikes the ground surface slightly behind the desired position for striking the golf ball, however the downward penetration and forward movement of the club head 10 provided by the entry region 34, the curved transition surface 40 and lobe 28 permit the club face 14 to move downwardly and forwardly under the golf ball in order place the face in proper striking position with the golf ball as the lobe 28 deflects off of the ground surface to provide the lift to the golf ball.

As will be recognized by those of ordinary skill in the pertinent art, numerous modifications and substitutions may be made to the above-described and other embodiments of the present invention without departing from the scope of the invention as set forth in the appended claims. For example, the lobe may be substituted by other designs for guiding the club head forwardly upon penetration of the leading edge with the ground surface. Accordingly, the preceding portion of this specification is to be taken in an illustrative, as opposed to a limiting sense.

What is claimed is:

1. A golf club head comprising:

a hosel for attaching the club head to a club shaft;

a club face defining a heel portion adjacent to the hosel, a toe portion located on an opposite side of the face relative to the heel portion, a leading edge forming a ground-contacting curved surface extending between the toe portion and the heel portion, and a trailing edge extending between the toe portion and the heel portion on an opposite side of the face relative to the leading edge;

a lobe spaced between the leading and trailing edges on an opposite side of the club head relative to the face and projecting outwardly therefrom above the leading edge, wherein the lobe define:s a first club-head thickness;

an entry region located below the lobe and adjacent to the leading edge on an opposite side of the club head relative to the face, and spaced inwardly from the lobe to thereby define a second club-held thickness less than the first club head thickness; and a curved transition surface extending between the lobe and the entry region, whereupon a downward stroke of the club head against a ground surface, the leading edge, entry region and the curved transition surface penetrate the ground surface prior to contact of the ground surface by the lobe.

2. A golf club head as defined in claim 1, wherein the lobe is located approximately midway between the leading edge and the trailing edge of the club face.

3. A golf club head as defined in claim 1, wherein the lobe and the transition surface each define a radius of curvature, and wherein the radius of curvature of the transition surface is larger than the radius of curvature of the lobe.

4. A golf club head as defined in claim 1, wherein the first club-head thickness of the lobe is defined as the distance between the club face and an outermost portion of the lobe relative to the club face.

5. A golf club head as defined in claim 1, wherein the second club head thickness of the entry region is defined as the distance between the club face and an oppositely oriented surface of the entry region.

6. A golf club head as defined in claim 1, wherein the curved transition surface is generally concave.

7. A golf club head as defined in claim 1, wherein the leading edge defines a substantially uniform club head thickness extending from the heel to the toe, the club head thickness of the leading edge less than the first club-head thickness.

8. A golf club head as defined in claim 7 wherein the club head thickness of the leading edge is equal to the second club-head thickness.

9. A golf club head comprising:

a hosel for attaching the club head to a club shaft;

a club face defining a heel portion adjacent to the hosel, a toe portion located on an opposite side of the face relative to the heel portion, a leading edge forming a ground-contacting curved surface extending between the toe portion and the heel portion, and a trailing edge extending between the toe portion and the heel portion on an opposite side of the face relative to the leading edge;

first means for facilitating penetration of the leading edge downwardly into a ground surface;

second means spaced above the leading edge on an opposite side of the club head relative to the face for guiding the club head generally forwardly upon penetrating the ground surface.

10. A golf club head as defined in claim 9, wherein the second means includes a lobe spaced between the leading and trailing edges on an opposite side of the club head relative to the face and projecting outwardly therefrom, and a curved transition surface extending between the lobe and the first means, the lobe defining a first club head thickness, and wherein the first means includes an entry region located below the lobe and adjacent to the leading edge on an opposite side of the club head relative to the face, and spaced inwardly from the lobe to thereby define a second club head thickness less than the first club head thickness, whereupon a downward stroke of the club head against a ground surface, the leading edge, entry region and the curved transition surface penetrate the ground surface prior to contact of the ground surface by the lobe.

11. A golf club head as defined in claim 10, wherein the lobe is located approximately midway between the leading edge and the trailing edge.

12. A golf club head as defined in claim 10, wherein the lobe and the transition surface each define a radius of curvature, and wherein the radius of curvature of the transition surface is larger than the radius of curvature of the lobe.

13. A golf club head as defined in claim 10, wherein the first club-head thickness of the lobe is defined as the distance between the club face and an outermost portion of the lobe relative to the club face.

14. A golf club head as defined in claim 10, wherein the second club head thickness of the entry region is defined as the distance between the club face and an oppositely oriented surface of the entry region.

15. A golf club head as defined in claim 10, wherein the curved transition surface is generally concave.

16. A golf club head as defined in claim 10, wherein the leading edge defines a substantially uniform club head thickness extending from the heel to the toe, the club head thickness of the leading edge less than the first club-head thickness.

17. A golf club head as defined in claim 16, wherein the club head thickness of the leading edge is equal to the second club-head thickness.

18. A golf club head as defined in claim 9, wherein the leading edge defines a substantially uniform club head thickness extending from the heel to the toe.

* * * * *